US005943524A

United States Patent [19]

Eom

[11] Patent Number: 5,943,524

[45] Date of Patent: Aug. 24, 1999

[54] METHOD FOR DRIVING ELECTROGAPHIC IMAGING APPARATUS

[75] Inventor: Yoon-seop Eom, Suwon, Rep. of Korea

[73] Assignee: Samsung Electronics Co., Ltd., Kyungki-do, Rep. of Korea

[21] Appl. No.: 09/071,193

[22] Filed: May 4, 1998

[30] Foreign Application Priority Data

Jul. 30, 1997 [KR] Rep. of Korea ..... 97-36179

[51] Int. Cl.[6] ..... G03G 15/00; G03G 21/00

[52] U.S. Cl. ..... 399/18; 399/19; 399/21

[58] Field of Search ..... 399/18, 19, 20, 399/21, 307

[56] References Cited

U.S. PATENT DOCUMENTS 4,937,622 6/1990 Makiura ..... 399/21

5,200,789 4/1993 Oshiumi ..... 399/18

5,479,240 12/1995 Lee et al. ..... 399/21

5,650,253 7/1997 Baker et al. ..... 399/307 X 5,678,123 10/1997 Kim ..... 399/21

*Primary Examiner*—Fred L. Braun

*Attorney, Agent, or Firm*—Sughrue, Mion, Zinn, Macpeak & Seas, PPLC

[57] ABSTRACT

A method for driving an electrographic imaging unit. The method involves interrupting the operation of the imaging unit when an operational error occurs, resuming the operation of the imaging unit when the operation error is cleared within a predetermined time, and operating at least one of a photosensitive belt, a transfer roller, a fixation roller and a cleaning roller when the operational error is not cleared within the predetermined time.

7 Claims, 5 Drawing Sheets

METHOD FOR DRIVING ELECTROGAPHIC IMAGING APPARATUS

BACKGROUND OF THE INVENTION

1. Field of the Invention

The present invention relates to a method for driving an electrographic imaging apparatus, and more particularly, to a method for driving an electrographic imaging apparatus which enables each individual component to independently operate according to the state of error without stopping the entire operation of the apparatus.

2. Description of the Related Art

In a typical electrographic imaging apparatus, a photosensitive member such as a photosensitive belt is charged and the photosensitive belt is scanned by a laser according to image signals to thereby form an electrostatic latent image. The electrostatic latent image is developed by a developing apparatus using toner and the developed image is transferred by a transfer roller to print on a paper. The image is fixed on the paper by applying heat and pressure using a fixation roller.

During the operation of the electrographic imaging apparatus, when the paper supplied by a paper feeding apparatus is not supplied accurately, a jam sensor detects the incorrect supply of paper. The jam sensor comprises a timer and a sensor and detects whether the paper is supplied to a predetermined position at a predetermined time. That is, the timer operates as soon as the paper is removed from a paper cassette and sends a time signal to a controller. Also, the sensor detects the paper passing through a predetermined point in a passage and sends a paper detecting signal to the controller. Then, the controller compares the input signals with reference signals. If the paper detecting signal is not input to the controller at a set reference time, the controller generates a jam signal to stop the operation of the imaging apparatus. Concurrently, an indication of a paper jam is displayed on an external panel.

When a paper jam occurs as above, the entire operation of the imaging apparatus stops. Thus, toner remains on the photosensitive belt and the transfer roller. Also, since the heat and pressure are continuously applied to contact portions between the fixation roller and the transfer roller, and the transfer roller and the paper, during the halted state of the apparatus, parts of the apparatus may become damaged and the life thereof may be shortened.

SUMMARY OF THE INVENTION

To solve the above problems, it is an objective of the present invention to provide a method for driving an electrographic imaging apparatus which enables each of the individual components of the imaging apparatus to operate according to the state of error. Accordingly, when an error such as a paper jam occurs during the operation of the apparatus, the operation of entire apparatus is not interrupted for a lengthy amount of time.

To achieve the above objective, the present method is employed in an electrographic imaging unit including a photosensitive belt, a print unit having a transfer roller for transferring an image formed on the photosensitive belt to a paper and a fixation roller for fixing the image transferred to the paper, a cleaning unit for removing charges and/or toner remaining on the photosensitive belt, a paper pickup sensor for detecting when the paper is picked up from a paper cassette feeding unit, a paper feeding sensor for detecting when the paper is supplied to the print unit, and a paper output sensor for detecting when the paper printed in the print unit is output therefrom. The method comprises the steps of: (a) halting the operation of the imaging unit when an operational error occurs; (b) resuming the operation of the imaging unit when the operational error is cleared within a predetermined time; and (c) operating at least one of the photosensitive belt, the transfer roller, the fixation roller and the cleaning unit when the operational error is not cleared within the predetermined time.

Preferably, when the operational error is a paper pickup error detected by the paper pickup sensor, the step (c) comprises the sub-steps of: ($c_1$) separating the photosensitive belt from the transfer roller; and ($c_2$) removing charges and/or toner remaining on the photosensitive belt by driving the photosensitive belt and operating the cleaning unit. When the operational error is a paper feeding error detected by the paper feeding sensor, the step (c) comprises the sub-steps of: ($c_1$) separating the photosensitive belt from the transfer roller; and ($c_2$) removing charges and/or toner remaining on the photosensitive belt by driving the photosensitive belt and operating the cleaning unit.

The above and other features of the invention including various and novel details of method steps will now be more particularly described with reference to the accompanying drawings and pointed out in the claims. It will be understood that the particular method for driving an electrographic imaging unit embodying the invention is discussed by way of illustration only and not as a limitation of the invention. The principles and features of this invention may be employed in varied and numerous embodiments without departing from the scope of the invention.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
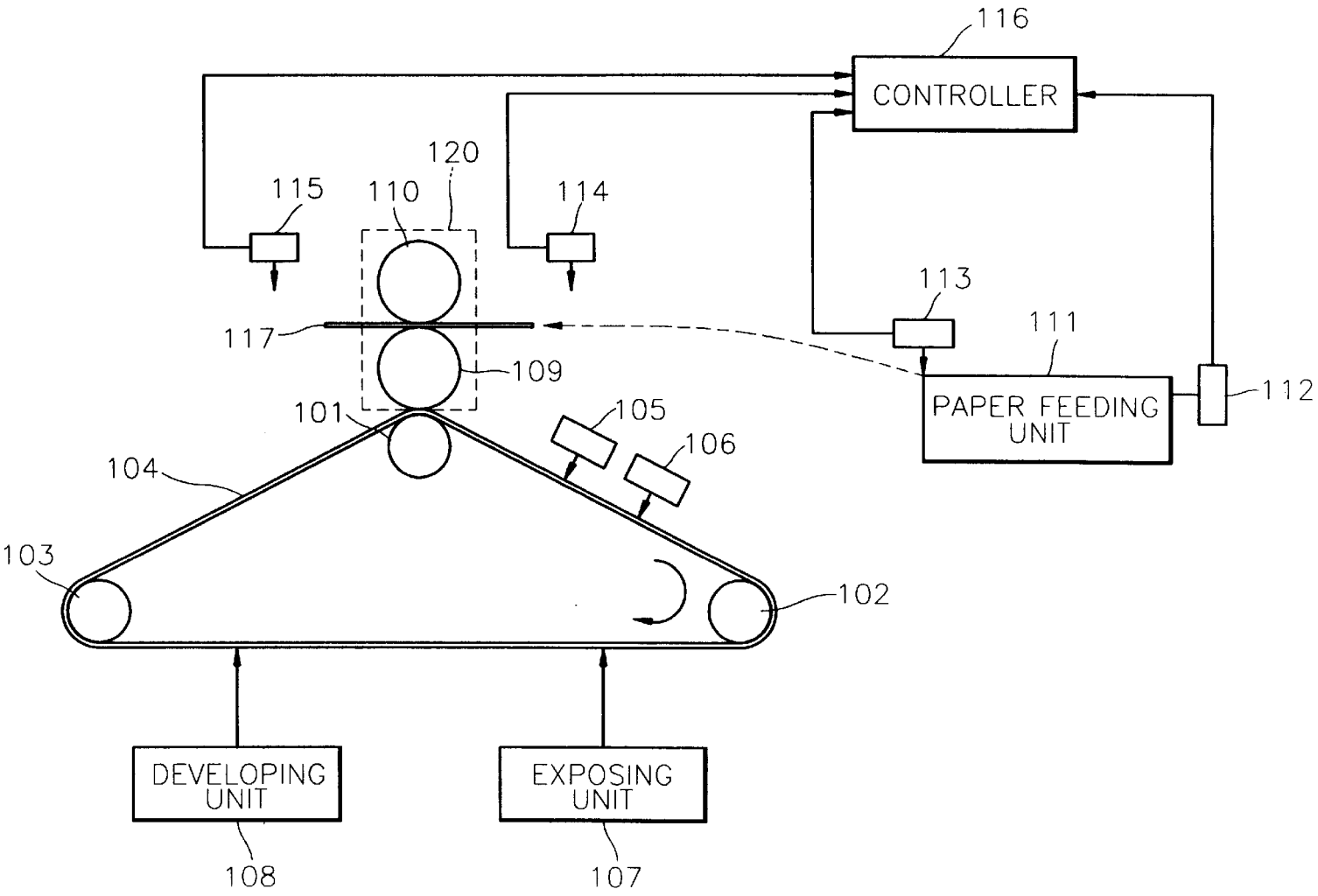
FIG. 1 is a block diagram of an imaging apparatus employing a driving method according to the present invention.

Referring to FIG. 1, in an electrographic imaging apparatus employing a method according to the present invention, a photosensitive belt 104 is supported by first, second and third rollers 101, 102 and 103, respectively, and moves in the direction indicated by an arrow. The rotation of the first, second and third rollers 101, 102 and 103, respectively, is controlled by a controller 116.

After any residual charges and toner remaining on the photosensitive belt 104 are removed by a cleaning unit 105, the surface of the photosensitive belt 104 is charged by a charging unit 106 to a predetermined uniform electric potential. Next, an exposing unit 107, such as a laser scanning unit, forms an electrostatic latent image in an image forming area of the photosensitive belt 104 by emitting a laser beam according to image signals. The electrostatic latent image of the photosensitive belt 104 is developed by a developing unit 108 which supplies a liquid toner. Thus, a developed image is formed.

A paper 117 is supplied by a paper feeding unit 111 between a transfer roller 109 and a fixation roller 110. The developed image is transferred to the paper 117 via the transfer roller 109, and simultaneously, the fixation roller 110 applies heat and pressure to the paper 117 so that the transferred image can be fixed thereon.

According to the present invention, a motor (not shown) for driving the first, second and third rollers 101, 102 and 103, respectively, and a system driving means (not shown) are controlled by the controller 116 in order to ensure accurate printing of an image on the paper 117.

Figure 2:
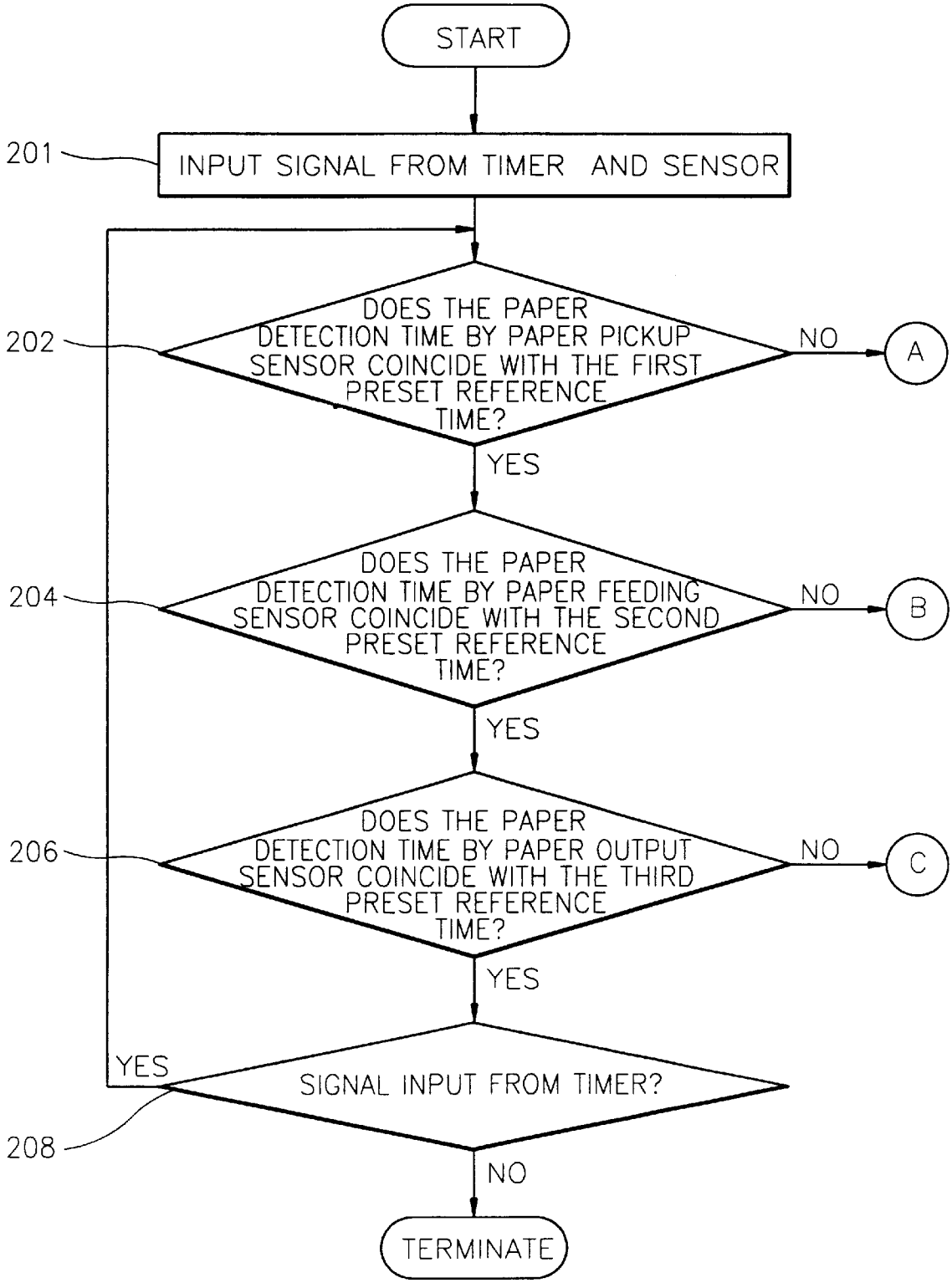
FIG. 2 is a flow chart of the method for driving an imaging apparatus according to the present invention.

In step 201 of FIG. 2, the moment the paper 117 is supplied by a pickup roller (not shown) from the paper feeding unit 111 (see FIG. 1), a timer 112 operates and transmits a time signal to the controller 116. A paper pickup sensor 113 detects when the paper is picked up from the paper feeding unit 111 and transmits a detection signal to the controller 116. Also, a paper feeding sensor 114 is installed at an inlet of a print unit 120 which includes the transfer roller 109 and the fixation roller 110. The paper feeding sensor 114 detects when the paper is supplied to the print unit 120 and transmits a detection signal to the controller 116. A paper output sensor 115 is installed at an output of the print unit 120, and detects when the paper is output from the print unit 120 and transmits a detection signal to the controller 116.

The controller 116 compares the input detection signals with preset reference signals. If they are the same, the controller outputs a control signal for continuously operating the imaging unit. On the other hand, if the compared signals do not coincide with each other, the controller outputs a jam indication signal and an external panel (not shown) indicates a paper jam. Concurrently, the operation of each of the individual components of the imaging unit is interrupted. If the paper jam is removed within a predetermined time, the operation of the individual components resumes. However, if a predetermined time elapses after the paper jam occurs, the controller 116 operates each of the photosensitive belt 104, the cleaning unit 105, the transfer roller 109 and the fixation roller 110 according to the location of the paper jam, regardless of whether the paper jam has been cleared.

More specifically, in step 202 of FIG. 2, the controller 116 determines whether a preset first reference time coincides with the paper detection time of the paper pickup sensor 113 which is based on the detection signal and the time signal transmitted from the paper pickup sensor 113 and the timer 112, respectively. If the compared times do not coincide, the sequence proceeds to a paper pickup jam controlling step (see FIG. 3). If the times coincide, the controller 116 determines whether a second preset reference time coincides with the paper detection time of the paper feeding sensor 114 which is based on the detection signal and the time signal transmitted from the paper feeding sensor 114 and the timer 112, respectively (step 204).

Figure 4:
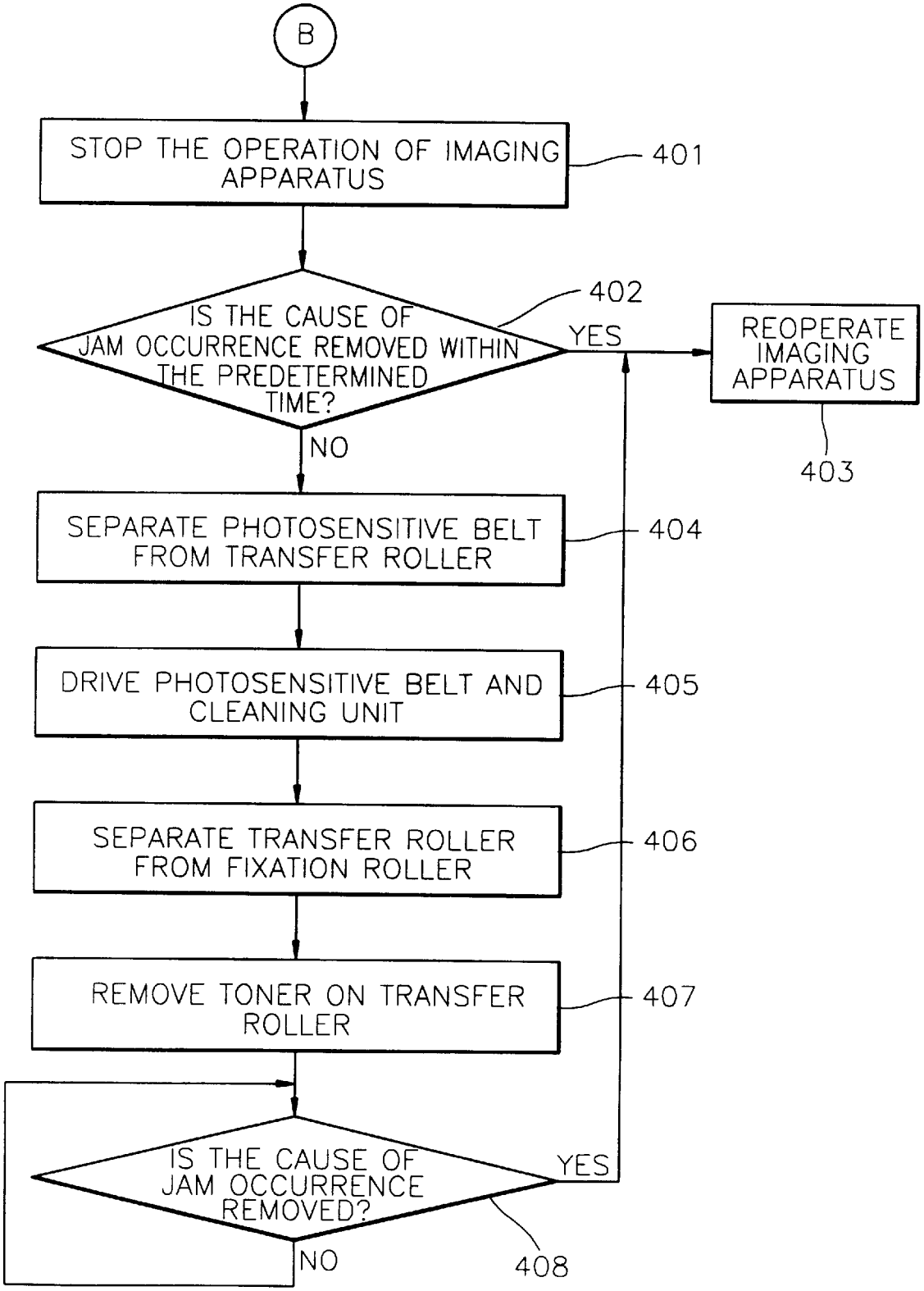
FIG. 4 is a flow chart of the steps for controlling a paper feeding jam according to the present invention.

In step 204, if the times do not coincide, the sequence proceeds to a paper feeding jam controlling step (see FIG. 4). If the times coincide, the controller 116 determines whether a third preset reference time coincides with the paper detection time of the paper output sensor 115 which is based on the detection signal and time signal transmitted from the paper output sensor 115 and the timer 112, respectively (in step 206).

Figure 5:
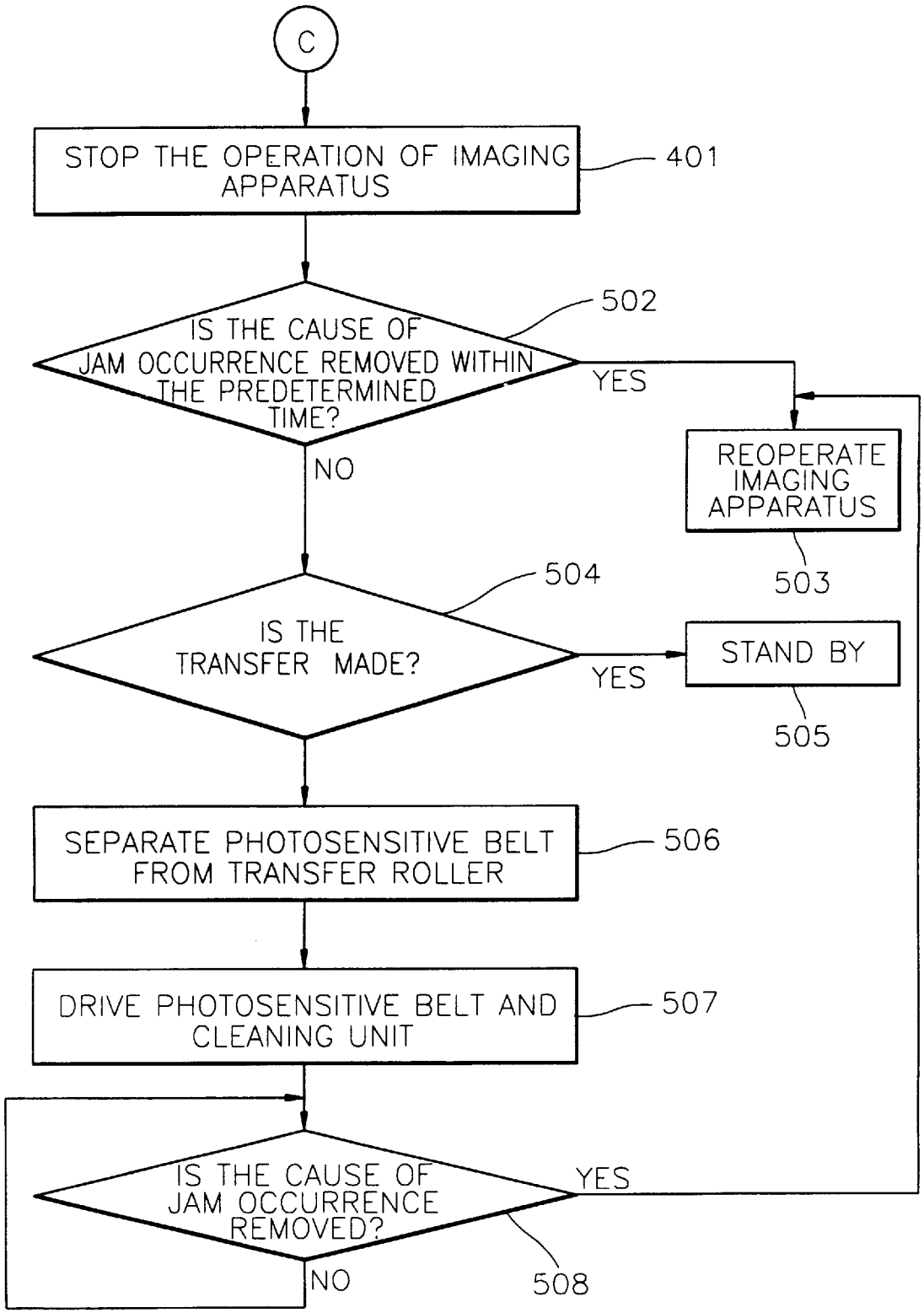
FIG. 5 is a flow chart of the steps for controlling a paper output jam according to the present invention.

In step 206, if the times do not coincide, the sequence proceeds to a paper output jam controlling step (see FIG. 5). If the times coincide, the timer 112 is reset as a new paper is supplied and the controller 116 determines whether a time signal generated from the timer is input in step 208. When the time signal is determined to be input from the timer 112 in step 208, the sequence returns to step 202. Otherwise, the sequence is terminated.

Figure 3:
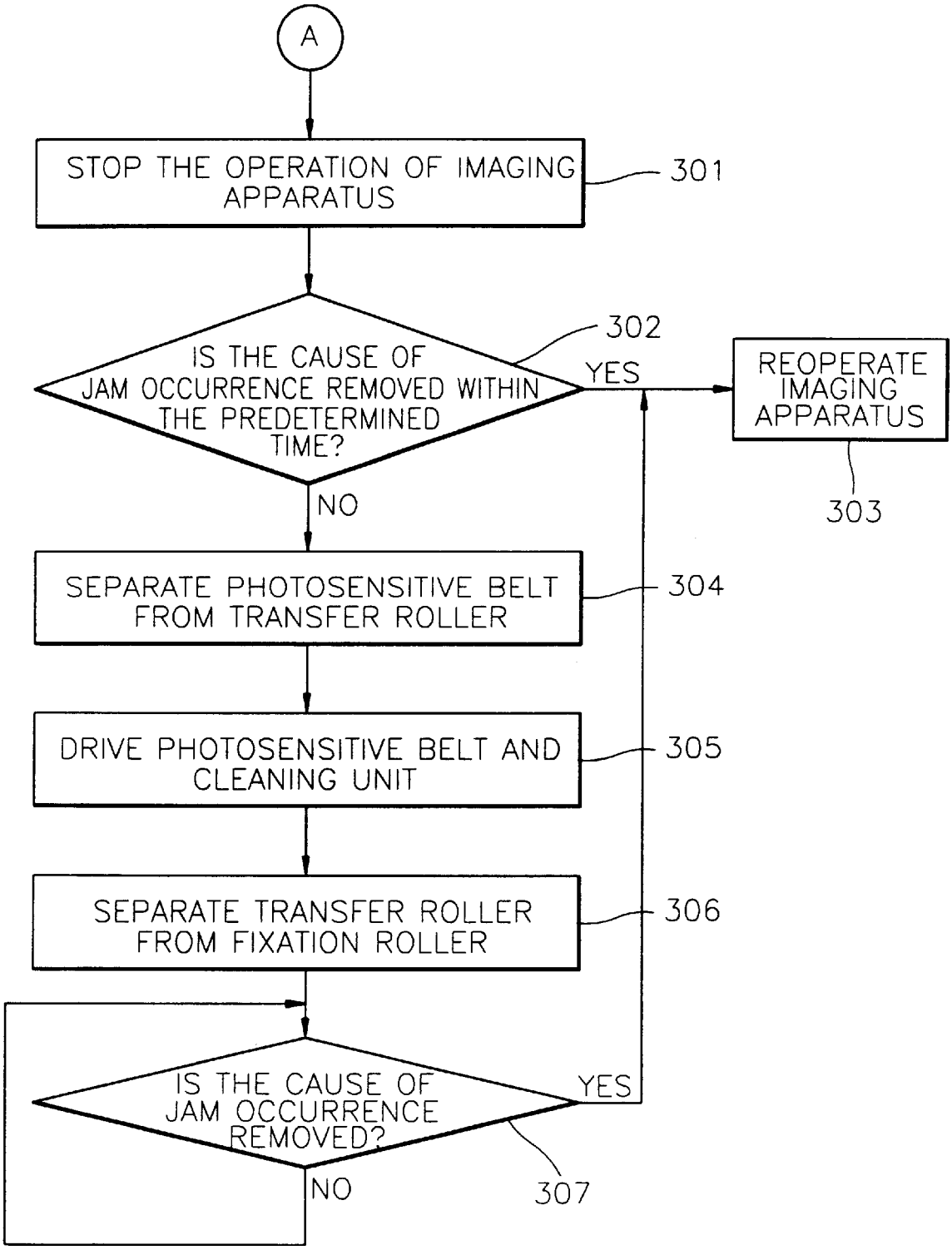
FIG. 3 is a flow chart of the steps for controlling a paper pickup jam according to the present invention.

With reference to FIG. 3, the paper pickup jam controlling step operates if a paper jam occurs as the paper is picked up from the paper feeding unit 111.

In step 301, if the paper detection time of the paper pickup sensor 113 and the first reference time do not coincide (see step 202 of FIG. 2), the controller 116 outputs the jam indication signal for interrupting the operation of the imaging unit. In step 302, it is determined whether the paper jam is removed within a predetermined time. If so, the controller 116 synchronizes the individual components, and thereafter, resumes the operation of the imaging unit (step 303).

If the paper jam is not removed within a predetermined time in step 302, the photosensitive belt 104 and the transfer roller 109 are separated from each other in step 304. In step 305, the first, second and third rollers 101, 102 and 103 are rotated to drive the photosensitive belt 104, and simultaneously, the cleaning unit 105 is operated to remove the charges and/or toner remaining on the photosensitive belt 104.

In step 306, the transfer roller 109 and the fixation roller 110 are separated according to the signals from the controller 116 to avoid contaminating the fixation roller.

If the paper pickup jam occurs during printing, it is preferable to interrupt the operation of paper feeding unit 111 to prevent a further supply of paper, and to continue the printing of a paper already supplied.

In step 307, it is determined again whether the paper jam is removed. The determination repeats until the paper jam is, removed. Once the paper jam is removed, the sequence proceeds to step 303 where the operation of the imaging unit is resumed. Here, the controller 116 synchronizes the individual components, and thereafter, resumes the operation of the imaging unit.

With reference to FIG. 4, the paper feeding jam controlling step operates if the paper is not supplied to the print unit 120 within a predetermined time. The occurrence of a paper jam is detected by the paper feeding sensor 114 which detects the supplied paper.

In step 401, if the paper detection time of the paper feeding sensor 114 and the second reference time do not coincide (see step 204 of FIG. 2), the controller 116 outputs the jam indication signal for interrupting the operation of the imaging unit. In step 402, it is determined whether the paper jam is removed within a predetermined time. If so, the controller 116 synchronizes the individual components, and thereafter, operates the imaging unit as normal (step 403).

If the paper jam is not removed within a predetermined time in step 402, the photosensitive belt 104 and the transfer roller 109 are separated from each other in step 404. In step 405, the photosensitive belt 104 and the cleaning unit 105 are driven to remove the charges and/or toner remaining on the photosensitive belt 104.

In step 406, the transfer roller 109 and the fixation roller 110 are separated from each other according to the signals from the controller 116 to avoid contaminating the fixation roller.

In step 407, a blade (not shown) is operated to remove toner that remains on the transfer roller 109. Also, in step

408, it is determined again whether the paper jam is removed. The determination is repeated until the paper jam is removed. Once the paper jam is removed, the sequence proceeds to step 403 where the operation of the imaging unit is resumed. Here, the controller 116 synchronizes the individual components, and then, resumes operation of the imaging unit.

With reference to FIG. 5, the paper output jam controlling step operates if a paper jam occurs as the paper is output from the print unit 120.

In step 501, if the paper detection time of the paper output sensor 115 and the third reference time do not coincide (see step 206 of FIG. 2), the controller 116 outputs the jam indication signal for interrupting the operation of the imaging unit. In step 502, it is determined whether the paper jam is removed within a predetermined time. If so, the operation of the imaging unit is resumed in step 503.

If the paper jam is not removed within the predetermined time in step 502, it is determined whether the paper jam occurred after the completion of toner transfer from the transfer roller 109, in step 504. If so, the system waits for user input since there is no possibility of damaging the transfer roller 109, in step 505. If the paper jam occurred before the completion of toner transfer in step 504, the photosensitive belt 104 and the transfer roller 109 are separated from each other, in step 506. In step 507, the photosensitive belt 104 and the cleaning unit 105 are driven to remove the charges and/or toner remaining on the photosensitive belt 104. In step 508, it is determined again whether the paper jam is removed. The determination step is repeated until the paper jam is removed. Once the paper jam is removed, the sequence proceeds to step 503 where the operation of the imaging unit is resumed. Here, the controller 116 synchronizes the individual components, and then, resumes the operation of the imaging unit.

As described above, in the method for driving an imaging unit according to the present invention, the individual components of the imaging unit are controlled separately according to the location of the paper jam. In this way, the present method prevent the contamination of the apparatus and the fixation of toner to the apparatus which result from a lengthy interruption in the operation of the entire system. Thus, the life and efficient operation of the imaging unit are improved.

What is claimed is:

1. A method for driving an electrographic imaging unit including a photosensitive belt, a print unit having a transfer roller for transferring an image formed on said photosensitive belt to a paper and a fixation roller for fixing said image transferred to said paper, a cleaning unit for removing at least one of a charge and a toner from said photosensitive belt, a paper pickup sensor for detecting when said paper is picked up from a paper cassette feeding unit, a paper feeding sensor for detecting when said paper is supplied to said print unit, and a paper output sensor for detecting when said paper is output from said print unit, said method comprising the steps of:

(a) halting an operation of said imaging unit when an operational error occurs;

(b) resuming said operation of said imaging unit when said operational error is cleared within a predetermined time; and (c) operating at least one of said photosensitive belt, said transfer roller, said fixation roller and said cleaning unit when said operational error is not cleared within said predetermined time.

2. The method for driving an electrographic imaging unit as claimed in claim 1, wherein, when said operational error is a paper pickup error detected by said paper pickup sensor, said step (c) comprises the sub-steps of:

($c_1$) separating said photosensitive belt from said transfer roller; and ($c_2$) simultaneously driving said photosensitive belt and operating said cleaning unit to remove said at least one of said charge and said toner from said photosensitive belt.

3. The method for driving an electrographic imaging unit as claimed in claim 2, further comprising the step of separating said transfer roller from said fixation roller.

4. The method for driving an electrographic imaging unit as claimed in claim 1, wherein, when said operational error is a paper feeding error detected by said paper feeding sensor, said step (c) comprises the sub-steps of:

($c_1$) separating said photosensitive belt from said transfer roller; and ($c_2$) simultaneously driving said photosensitive belt and operating said cleaning unit to remove said at least one of said charge and said toner from said photosensitive belt.

5. The method for driving an electrographic imaging unit as claimed in claim 4, further comprising the step of removing said toner remaining on said transfer roller.

6. The method for driving an electrographic imaging unit as claimed in claim 5, further comprising the step of separating said transfer roller from said fixation roller.

7. The method for driving an electrographic imaging unit as claimed in claim 1, wherein, when said operational error is a paper output error detected by said paper output sensor, said step (c) comprises the sub-steps of:

($c_1$) determining whether a toner transfer from said transfer roller to said paper is complete;

($c_2$) waiting for a user input when said toner transfer is complete; and ($c_3$) separating said photosensitive belt from said transfer roller when said toner transfer is not complete, and simultaneously driving said photosensitive belt and operating said cleaning unit to remove said at least one of said charge and said toner from said photosensitive belt.

* * * * *